US010329052B2

(12) United States Patent
Oberly

(10) Patent No.: US 10,329,052 B2
(45) Date of Patent: Jun. 25, 2019

(54) PROTECTIVE COVERS FOR UPSTANDING CONTAINERS OF LIQUID

(71) Applicant: Chad M Oberly, Wooster, OH (US)

(72) Inventor: Chad M Oberly, Wooster, OH (US)

( * ) Notice: Subject to any disclaimer, the term of this patent is extended or adjusted under 35 U.S.C. 154(b) by 18 days.

(21) Appl. No.: 15/731,597

(22) Filed: Jul. 6, 2017

(65) Prior Publication Data

US 2018/0009569 A1 Jan. 11, 2018

Related U.S. Application Data

(63) Continuation-in-part of application No. 29/620,114, filed on Jul. 8, 2016, now Pat. No. Des. 843,214.
(Continued)

(51) Int. Cl.

| | |
|---|---|
| ***B65D 23/08*** | (2006.01) |
| ***B65D 41/62*** | (2006.01) |
| ***B65D 41/04*** | (2006.01) |
| ***B67C 11/02*** | (2006.01) |
| ***B65D 1/02*** | (2006.01) |

(52) U.S. Cl.
CPC ..... *B65D 23/0885* (2013.01); *B65D 1/0246* (2013.01); *B65D 23/0842* (2013.01); *B65D 41/04* (2013.01); *B65D 41/62* (2013.01); *B67C 11/02* (2013.01)

(58) Field of Classification Search
CPC .. B65D 23/0885; B65D 1/0246; B65D 41/04; B65D 41/62; B65D 77/0493; B65D 23/0842; B65D 23/0878; B67C 11/02; A61J 9/08
USPC ..... 229/87.05, 87.01; 215/12.1, 11.6, 246, 215/251, 256; 220/903
See application file for complete search history.

(56) References Cited

U.S. PATENT DOCUMENTS

| | | | | |
|---|---|---|---|---|
| 34,004 A | 12/1861 | Morrison | ..... | 141/343 |
| 60,806 A | 1/1867 | Trent | ..... | 222/461 |

(Continued)

OTHER PUBLICATIONS

QuickFill Funnel, posted on walmart.com, earliest reviewed Dec. 9, 2015, no production date given, [online], [site visited Feb. 5, 2018], Available from Internet, URL: https://www.walmart.com/ip/Hopkins-10705-FloTool-Giant-QuickFill-Funnel/17127130 (Year: 2015), 4 Pages.

(Continued)

*Primary Examiner* — Christopher R Demeree
(74) *Attorney, Agent, or Firm* — David A. Burge

(57) ABSTRACT

A protective cover that closely overlies an exterior surface of an upstanding container for holding liquid has integrally formed portions that are separately removable from the container. Each of two substantially adjacent removable cover portions preferably snugly wraps substantially adjacent surface areas of the container's exterior, and is releasably coupled by a narrow tear-off strip portion of the cover that also perimetrically wraps the container's exterior. One removable cover portion preferably helps to hold a cap in a closed orientation on the container's neck. Another removable cover portion preferably underlies a bottom part of the container's exterior surface, and thereby helps to hold the protective cover in place on the container. Yet another removable cover portion preferably wraps and grips a major part of the container's upstanding sidewall, and forms a disposable funnel when removed from the container's exterior.

20 Claims, 5 Drawing Sheets

Related U.S. Application Data

(60) Provisional application No. 62/493,547, filed on Jul. 8, 2016.

(56) References Cited

U.S. PATENT DOCUMENTS

| | | | | |
|---|---|---|---|---|
| 129,024 | A | 7/1872 | George | 141/343 |
| 398,390 | A | 2/1889 | Greely | 141/343 |
| 584,275 | A | 6/1897 | Sevier | 141/343 |
| 589,659 | A | 9/1897 | Krack | 141/343 |
| 733,986 | A | 7/1903 | Jack | 222/108 |
| 790,080 | A | 5/1905 | Seavy | 141/343 |
| 1,074,697 | A | 10/1913 | Cox | 222/461 |
| 1,817,061 | A * | 8/1931 | Bobrick | B65D 23/0885 229/123.1 |
| 2,238,253 | A | 4/1941 | Dick | 206/56 |
| 2,666,542 | A * | 1/1954 | Price | B65D 41/62 215/232 |
| 3,016,133 | A | 1/1962 | Jones | 206/47 |
| 3,915,360 | A | 10/1975 | Leger et al. | 222/538 |
| 4,197,890 | A * | 4/1980 | Simko | A45C 11/20 215/12.1 |
| 5,101,870 | A | 4/1992 | Farris | 141/343 |
| D340,731 | S | 10/1993 | Pollak | D15/150 |
| 5,305,910 | A | 4/1994 | Pollacco | 220/771 |
| D389,439 | S | 1/1998 | Larson | D15/150 |
| D395,603 | S | 6/1998 | Harris | D9/447 |
| 6,070,753 | A | 6/2000 | Hirst et al. | 220/674 |
| D534,074 | S | 12/2006 | Stillerud | D9/523 |
| 7,237,583 | B2 | 7/2007 | Salani et al. | 141/337 |
| 7,240,701 | B2 | 7/2007 | Salani et al. | 141/337 |
| D600,125 | S | 9/2009 | Tarnacki et al. | D9/523 |
| D621,266 | S | 8/2010 | Smith | D9/516 |
| D628,896 | S | 12/2010 | Smith | D9/516 |
| D650,285 | S | 12/2011 | Smith | D9/516 |
| 8,118,198 | B1 | 2/2012 | Watson | 222/462 |
| D693,691 | S | 11/2013 | Nachtsheim | D9/523 |
| D703,010 | S | 4/2014 | Meyer | D7/700 |
| D708,919 | S | 7/2014 | Lin | D7/700 |
| D722,269 | S | 2/2015 | Hughes | D9/516 |
| D732,962 | S | 6/2015 | Hawry | D9/523 |
| 9,243,750 | B2 | 1/2016 | Tarnacki et al. | |
| D762,255 | S | 7/2016 | Levy | D15/150 |
| D782,909 | S | 4/2017 | Jost | D9/520 |
| D784,817 | S | 4/2017 | Heisner | D9/523 |
| D786,077 | S | 5/2017 | Chung | D23/211 |
| D796,257 | S | 9/2017 | Levy | D7/300 |
| D802,433 | S | 11/2017 | Ozamiz | D9/560 |
| D807,183 | S | 1/2018 | Ferrone | D9/523 |
| D807,752 | S | 1/2018 | Koelsche | D9/523 |
| 2003/0230595 | A1 | 12/2003 | Piechocki et al. | 222/92 |
| 2003/0231808 | A1 | 12/2003 | Machacek et al. | 383/36 |
| 2005/0279762 | A1 | 12/2005 | Bodum | 222/109 |
| 2006/0191983 | A1 | 8/2006 | Cargile, Jr. | 229/103 |
| 2008/0314862 | A1 * | 12/2008 | Matsuoka | B65D 1/40 215/382 |
| 2009/0298383 | A1 * | 12/2009 | Yarro | B65D 1/0223 446/267 |
| 2014/0367281 | A1 | 12/2014 | Colvin | B65D 65/04 206/204 |
| 2015/0272358 | A1 | 10/2015 | Humphreys | 220/254.1 |
| 2017/0361989 | A1 | 12/2017 | Moffett, III | B65D 25/205 |
| 2018/0002093 | A1 | 1/2018 | Kutsuzawa | B65D 79/005 |

OTHER PUBLICATIONS

Disposable Oil Funnel, posted on amazon.com, first available Jun. 26, 2011, no production date given, [online], [site visited Feb. 5, 2018], Available from Internet, URL: https://www.amazon.com/Disposable-Oil-Funnel-10-Pack/dp/B00589GZOI (Year: 2011), 5 Pages.

* cited by examiner

PROTECTIVE COVERS FOR UPSTANDING CONTAINERS OF LIQUID

CROSS-REFERENCE TO RELATED APPLICATIONS

The present application claims the benefit of Provisional Application Ser. No. 62/493,547 filed Jul. 8, 2016, the disclosure of which is incorporated herein by reference.

The present application is a continuation-in-part of Design application Ser. No. 29/620,114 filed Jul. 8, 2016, the disclosure of which also is incorporated herein by reference.

BACKGROUND

Many upstanding containers capable of receiving, containing, transporting and storing liquid are provided with protective covers that closely overlie some or all parts of the exterior surfaces of the associated containers to serve one of a wide a variety of purposes.

These upstanding containers typically have centrally located interior chambers bordered by relatively flat bottom walls suitable to support the associated container atop a flat surface, as well as upwardly inclined top walls that join with upstanding sidewalls that extend between and connect peripheral parts of the bottom and top walls to cooperatively surround the centrally located interior chambers where liquids can be carried.

The upstanding containers are often provided with reduced diameter necks that extend upwardly from central regions of the top walls to where removable or openable caps of a variety of types and configurations are provided that selectively permit liquids to be introduced into, and withdrawn from, the interior chambers of the containers.

Protective covers carried by some of these upstanding containers help to retain removable caps on necks of the containers in closed and sealed positions until the caps are deliberately loosened and removed, or are pivoted from closed to open orientations.

Some protective covers are provided simply to releasably attach and protectively enclose information-containing pamphlets, or various other objects or articles, to the associated containers that purchasers will find useful when liquids carried in the containers are put to use. Caps that include sprayer nozzles are sometimes removably attached to containers by protective covers of this type.

Thermoplastic materials are sometimes used to form protective covers that can be heat shrunk to concurrently perform such dual tasks as 1) securely protectively surrounding an upstanding liquid-carrying container, while 2) gently releasably coupling to the protectively covered container some object of article that is intended to be removed and used by a purchaser of the liquid-carrying container just prior to when liquid from the container is to be dispensed and put to use.

Still another reason why an upstanding container capable of containing liquid may be provided with a protective cover is disclosed in U.S. Pat. No. 5,101,870 issued Apr. 7, 1992 to Roy Farris—the disclosure of which patent is incorporated herein by reference.

The Farris patent discloses a small, squat funnel that is carried only atop the top wall of an associated container that is typically used to carry motor oil or other automotive fluids such as are often sold in auto parts stores in upstanding plastic containers capable of housing one-quart, one pint, one-liter, one gallon, or other similar relatively small quantities of liquid.

The short, squat funnel of Farris overlies only the top walls of associated containers—which permits the funnels of Farris to protect only upper portions of associated containers before the funnels are removed from the associated containers, and then are used to duct motor oil or other automotive liquid that is poured from the associated containers and put to its intended use.

SUMMARY OF THE INVENTION

The present invention provides protective covers configured to closely continuously perimetrically wrap exterior surface areas of upstanding containers that are capable of receiving, retaining, transporting and storing relatively small quantities of liquid—such as a pint, a quart, a liter, and a gallon, or the like.

The protective covers have separately removable portions that preferably include at least a pair of cover portions that perimetrically wrap and tightly grip substantially adjacent parts of exterior surfaces of the associated containers.

In preferred practice, each protective cover includes at least a pair of adjacently located, separately removable cover portions that are releasably connected by a tear strip that can be pulled or otherwise torn away to disconnect the tear strip from one or both of the adjacently located removable cover portions.

In one preferred practice, each protective cover includes a removable cover portion that engages a cap of the container to prevent either removal of the cap from the associated container, or opening of the cap, or both.

In one preferred practice, each protective cover includes a removable cover portion that assists in retaining a cap of the container in a closed position or orientation where the cap is preferably carried on a reduced diameter, upstanding neck of the container.

In one preferred practice, prior to being removed from the container's exterior surface, one of the removable cover portions closely underlies a bottom part of the container's exterior surface to assist in holding the protective cover in place adjacent the exterior surface of the container.

In one preferred practice, prior to being removed from the container's exterior surface, one of the removable cover portions snugly grips a selected major exterior surface area of an upstanding sidewall of the container, including a reduced diameter upstanding neck of the container, to thereby form an inverted, relatively tall funnel that can be used, after being removed from the container, to duct liquid poured from the container into an engine opening (or the like) having a diameter smaller than a maximum diameter of the internal chamber of the container.

In one preferred practice, the removable cover portions are formed from a thermoplastic material that is heat shrunk to securely grip at least selected parts of associated container's exterior surface.

In one preferred practice, the protective cover includes two substantially adjacent regions of thermoplastic material that perimetrically wrap substantially adjacent parts of the exterior surface of the container, with the substantially adjacent regions being releasably connected along substantially adjacent edges of the substantially adjacent regions by a relatively narrow tear-off strip of cover material.

In one preferred embodiment, the protective cover is formed from thin, substantially transparent thermoplastic material that overlies and snugly wraps at least a major exterior surface area of the upstanding sidewall of the container, and protects information printed on the upstanding sidewall while permitting the information to be viewed legibly through the protective cover.

In one preferred embodiment, the protective cover is formed from a puncture-resistant plastic material that serves as a liquid barrier to retain liquid from the internal chamber of the container in the event that the container, itself, should leak or be punctured.

In one preferred embodiment, a protective cover for a liquid container, includes three integrally formed pieces of thermoplastic material that each perimetrically wraps an exterior part of the container's exterior surface, with the three pieces being configured to cooperatively extend perimetrically around adjacent regions of the exterior surface of the container, with each adjacent pair of the pieces of thermoplastic material being coupled by a separate, integrally formed tear strip that can be pulled to disconnect adjacent pairs of the pieces of thermoplastic material.

Although the present invention is particularly well suited to provide a relatively thin, relatively tall funnel that is disposable, those who are skilled in the art will readily appreciate that the present invention can also be used to provide a relatively thick and relatively tall funnel that overlies at least a major part of the exterior of the upstanding sidewall of an associated container, and can be repeatedly reused, rather than being discarded after relatively short periods of use.

BRIEF DESCRIPTION OF THE DRAWINGS

Other features and advantages of the invention will become apparent from the description and claims that follow, taken together with the accompanying drawings, wherein:

FIG. 3 is a perspective view showing the protectively covered upstanding container of FIG. 2 with a twist-on/twist-off cap that can be removed without any need to pull or otherwise remove an upper tear strip or rip cord to access the twist-on/twist-off cap—hence any protective-covers that provide inverted funnels (that are present on a sequence of containers of this type) need not all be removed from the associated containers once a first funnel has been removed from a first of the liquid-carrying containers and has been put in position to duct liquid poured from a sequence of all of the liquid-carrying containers into an engine's reservoir, or the like;

DETAILED DESCRIPTION

Figure 1:
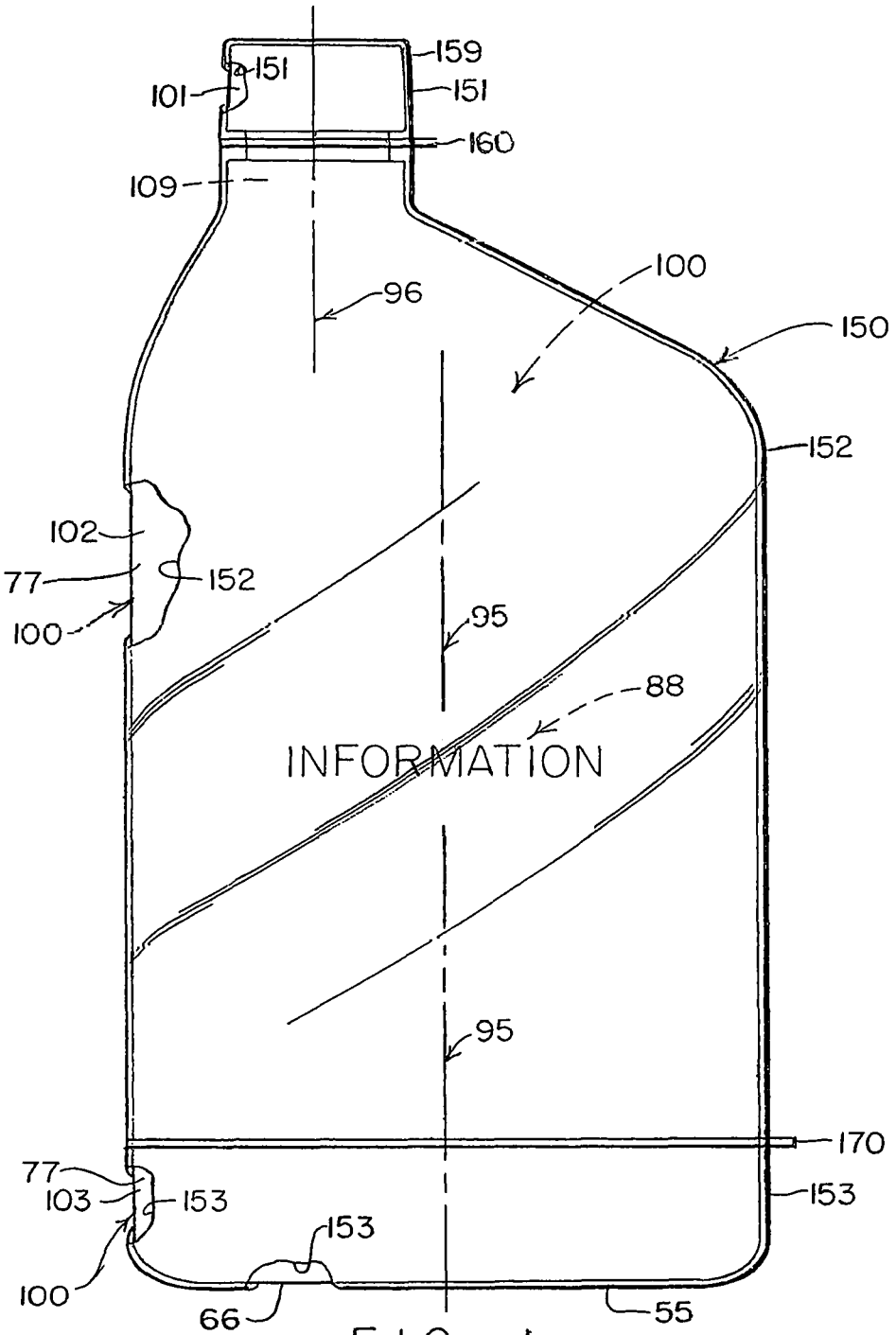
FIG. 1 is a side elevational view showing an elongate upstanding container typically formed from plastic material, with a relatively thin layer of transparent plastic material closely overlying the upstanding container to provide a protective cover that extends snugly around, so as to closely wrap, the perimeter parts of the upstanding container's exterior surface, with the protective cover including upper and lower tear strip or rip cord portions that perimetrically wrap the container to separate a lengthy upstanding central portion of the protective cover from relatively short bottom and top portions of the protective cover.
Figure 2:
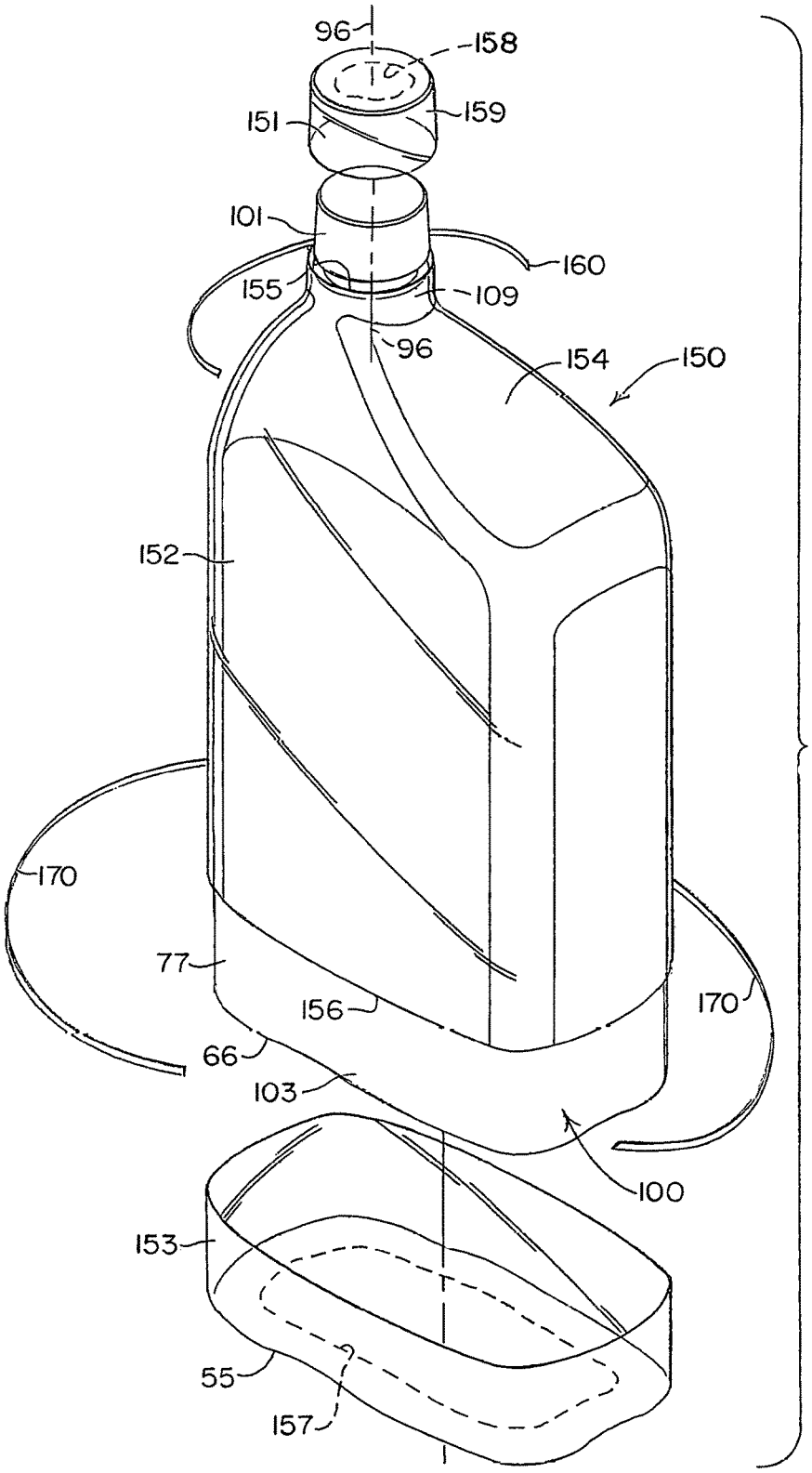
FIG. 2 is an exploded perspective view showing the upstanding container of FIG. 1, with upper and lower tear strips or rip cords being removed from the protective cover, with a cylindrical top portion of the protective cover removed and shown above the container so a twist-on and twist-off cap of the container can be viewed, and with a bottom portion of the protective cover removed and shown extending partially beneath the upstanding container, by which arrangement the inverted funnel shape of the upstanding central portion of the protective cover can be seen to still be in place on a central upstanding portion of the exterior surface of the container, with the view including two loops formed by broken lines which designate typical locations where the bottom and top portions of the protective cover can terminate while extending radially inwardly without fully underlying and/or without fully overlying the bottom wall and/or the cap of the associated container, respectively.

Shown in FIGS. 1 and 2, is a conventional, commercially available, upstanding, container 100 capable of receiving, retaining, transporting and storing common household and automotive liquids having a viscosity that permits the liquids to be easily poured when at room temperature—such as transmission fluid, motor oil, and the like.

The container 100 has 1) a relatively small diameter, upstanding, neck or neck part 109; 2) a tall, upstanding, relatively more sizeable central part 102 that has a more lengthy perimeter than does the neck or neck part 109 of the container 100; and, 3) a bottom part 103 of the container 100 that has a perimeter that matches and joins smoothly with the lowermost perimeter of the upstanding central part 102 of the container 100.

The material from which the commercially available container 100 is formed is often an opaque plastic material that provides an external surface 77 onto which information (indicated by the numeral 88 in FIG. 1) can be directly printed (or onto a label, not shown, that is adhered to an upstanding region of the exterior surface 77 of the container 100).

Also shown in FIGS. 1 and 2 is a relatively thin protective cover 150 that closely overlies and preferably snugly grips the exterior surface 77 of the upstanding container 100.

As is best shown in FIG. 2, a removable cap 101 (preferably of the twist-on/twist-off type) closes (or can be removed or moved to open) the upstanding, upwardly opening neck 109 of the container 100. As those who are skilled in the art will readily understand, the cap 101 is often provided with internal threads that engage external threads formed on an exterior surface of the upstanding neck 109 of the container 100.

The type of cap 101 that may be provided on the neck 109 of the upstanding container 100 is of little concern to the present invention, except that whatever type of cap 101 is chosen for selectively opening and closing an upwardly-facing opening of the container's neck 109 is preferably of a type having an exterior surface that can be gripped by the upper portion 151 of a protective cover 150 that surrounds the cap 101—so a gripping action of the container's upper portion 151 can help to hold the cap 101 in a position or orientation that closes an upwardly facing opening of the neck 109 of the container 100.

The protective cover 150 is preferably formed from transparent plastic material—for instance from a tear resistant and puncture resistant thermoplastic material such as cellophane, or a more sophisticated sun-resistant and perhaps even more durable film or layer of plastics material that has preferably been annealed to enhance its tear and puncture resistance as well as it pliability.

Although a wide range of thermoplastic materials can be used to form the protective layer or cover 150, materials that are suggested (without limiting the materials that can be selected) include 1) high density polyethylene (also known as "HDPE"), 2) low density polyethylene (also known as "LDPE"), 3) Polypropylene (also known as "PP") and 4) Polyethylene Terephthalate, or the like.

Although a wide range of material thicknesses can be used to form the protective layer 150, material thicknesses that are suggested (without limiting the material thicknesses that can be selected) include materials within a thickness range of 0.002 inches (i.e., 2 mils) to 0.010 inches (i.e., 10 mils), or the like.

Many features of the container's protective cover 150 are symmetrical about an imaginary upstanding central axis 95 shown in FIG. 1. However, the upstanding tubular neck portion 109 of the container 100, and an upstanding tubular portion 159 of the protective cover 150, concentrically encircle a different upstanding axis 96 that is offset from the upstanding central axis 95, as can be seen in FIG. 1.

In FIG. 1, the upper portion 151, a central portion 152, and a lower portion 153 of the protective cover 150 are broken away to permit the cap 101, the central part 102 of the container 100, and the lower part 103 of the container 100, respectively, to be seen. The components 151, 152 and 153 extend one adjacent the other, in series, and cooperate to form major portions of the protective cover 150.

In FIGS. 1 and 2, the protective cover 150 is shown to be provided with an upper tear strip, rip cord or the like, indicated by the numeral 160. Likewise, the protective cover 150 is also provided with a lower tear strip, rip cord or the like, indicated by the numeral 170. Each of the tear strips or rip cords 160, 170 can be pulled away from, removed from, or otherwise released from where they extend perimetrically around upper and lower portions 101 and 103 of the container 100, respectively, as is shown in FIG. 2. Moreover, the pulling, removal or release of each of the tear strips or rip cords 160, 170 can take place independently of the pulling, removal or release of the protective cover's other portions 151, 152 and 153 from the exterior surface 77 of the container 100.

As is shown in FIG. 2, the pulling, removal or release of the upper tear strip or rip cord 160 will separate the upper portion 151 of the protective cover 150 from the central portion 152 of the protective cover 150. When the upper tear strip or rip cord 160 is pulled, removed or released, the central region 152 of the protective cover will have an open upper end region 155 that has a relatively small circumference.

Likewise, the pulling, removal or release of the lower tear strip or rip cord 170 will separate the lower portion 153 of the protective cover 150 from the central portion 152 of the protective cover 150—which will leave the central region 152 of the protective cover 150 with a bottom opening 156 (FIG. 2) that has a relatively large perimeter in comparison to the relatively small circumference of the upper opening 155 (FIG. 2).

As is shown in FIG. 2, the protective cover 150 can have a top wall portion 154 that is upwardly inclined as the top wall portion extends generally away from the axis 95 toward the offset axis 96.

As is also shown in FIG. 2, the lower portion 153 of the protective cover 150 can have a bottom wall portion 55 that extends radially inwardly toward the axis 95 to at least partially underlie a perimetrically extending portion of the bottom wall 66 of the container 100.

A broken line 157 (seen only in FIG. 2 as forming an endless loop) designates one of many possible locations of an interior perimeter along which the bottom wall portion of the protective cover 150 can terminate if the bottom wall portion of the protective cover 150 is to stop short of fully protectively underlying the bottom wall 66 of the container 100.

Similarly, a broken line 158 (seen only in FIG. 2 as forming an endless loop) designates one of many possible locations of an interior perimeter along which a top wall portion of the protective cover 150 can terminate if the top wall portion of the protective cover 150 is to stop short of fully protectively overlying the top wall of the cap 101 of the container 100.

One preferred feature of the protective cover 150 is its see-through transparency which permits information printed directly onto the container 100 to be clearly viewed through the protective cover.

Another preferred feature of the protective cover 150 is that, even when the tear strips or rip cords 160, 170 are pulled, removed or otherwise caused to release the connections of the central portion 152 from the upper and lower portions 151, 153, respectively, of the protective cover 150, the upstanding central portion 152 of the cover 150 still tends to closely hug the central portion 102 of the container 100. By this arrangement, one can usually grip the protectively covered container 100 without receiving the sensation that the central portion 152 of the protective cover 150 is so loose as to be ready to fall off of the container 100.

Another preferred feature of the protective cover 150 is that its central portion 152 is intended to be removed from the container by sliding the central portion 152 of the protective cover 150 off of the exterior surface of the container 100 after the tear strips or rip cords 160, 170 are pulled, removed or otherwise released, so that the top portion 151 and the bottom portion 153 of the protective cover 150 are no longer connected to, nor do they serve to retain, the central portion 152 of the protective cover in place surrounding the central portion 102 of the container 100.

The "how" and "why" (that explain exactly how and exactly why the central portion 152 of the protective cover 150 can preferably be relatively easily slided off of the central portion 102 of the container 100) can be explained in a variety of ways that result from different approaches that may be taken to make it possible to slide the central portion 152 of the protective cover 150 off of the central portion 102 of the container 100.

Since the upper portion 151 of the protective cover 150 and the lower portion 153 of the protective cover 150 preferably overlie and underlie at least parts of opposite end regions of the container 100, the protective cover 150 can have an effectively invisible film of lubricant dispersed between at least the central portion 152 of the protective cover 150, and the container 100—without permitting leakage of the lubricant from top or bottom ends of the protectively covered container 100.

Another approach that can be taken to help make it possible for the central cover portion 152 to be removed from the central container portion 102 is to form the protective cover 150 from a somewhat flexible film or layer of plastics material that can stretch slightly (if need be) to permit the central cover portion 152 to be sliced off of the central container portion 102.

Since the protective cover 150 is preferably formed from a thin film or layer of transparent plastics material that is preferably stretchable to at least some small extent, the central region 152 of the protective cover 150 should be capable of being pulled off the container 100 once the upper end portion 151 and the lower end portion 153 of the protective cover 150 have been removed.

Another alternative (not shown in the drawings hereof) is to modify the configuration of the container 100 so that the exterior of the central portion 102 of the container 100 has a perimeter that steadily diminishes as it extends away from the vicinity of the relatively large perimeter end region 156 of the protective cover 150 toward the relatively small circumference end region 155. Tapering the exterior of the central portion 102 of the container 100 in this manner will cause the central portion 152 of the protective cover 150 to also taper in a corresponding manner—which will mean that the central portion 152 of the protective cover 150 can essentially be lifted off of the central portion 102 of the container 100.

What needs to be noted in FIG. 2 is that the central portion 152 of the protective cover 150 has a configuration that, when withdrawn from the container 100 and inverted, can serve nicely as a, relatively tall, high capacity funnel that is certainly not equalled by the low capacity of the short, squat, shallow funnel shown in the Farris patent.

Stated in another way, once the tear strips 160 and 170 are pulled or removed from extending perimetrically around the container 100, the central portion 152 of the protective cover actually becomes what is occasionally referred to as "the tall funnel 152" in the text that follows.

When the upper tear strip or rip cord 160 is removed from the tall funnel 152 (as is shown in FIG. 2), the end of the tall funnel 152 that was previously attached to the tear strip or rip cord 160 constitutes the smaller end of the tall funnel 152. Likewise, when the lower tear strip or rip cord 170 is removed from the tall funnel 152, the end of the tall funnel 152 that was previously attached to the tear strip or rip cord 170 constitutes the larger end of the tall funnel 152. When the tall funnel 152 is inverted (from the orientation shown in FIG. 2 hereof), the funnel's larger end region 156 opens upwardly, and its smaller end region 155 opens downwardly, whereby the tall funnel 152 is ready to be positioned near an inlet opening of an engine's reservoir or the like, so motor oil can be poured into and through the tall funnel 152, and through the inlet opening of the engine's reservoir.

A significant advantage of using the tall funnel 152 is the much greater liquid containing capacity of the tall funnel 152 as compared to the minimal liquid containing capacity of the short, squat, shallow funnel disclosed in the aforementioned Farris patent.

Moreover, the tall funnel 152 is much easier to grasp and grip than is the short, squat, shallow funnel of Farris. Losing one's grip on a funnel full of liquid such as oil is destined to create spillage when that is exactly what the provision of a funnel 152 is intended to minimize.

Still another advantage is that the tall funnel 152 can be made thin enough and flexible enough to permit its being squeezed or compressed so the tall funnel 152 can take whatever shape may be needed to permit liquid to be fed downwardly past components within a crowded engine compartment of a vehicle to snake around or to squeeze around various components within the engine compartment; yet, even if compressed or squeezed, the liquid-carrying capacity of the tall funnel 152 will still be significantly greater than that of the Farris funnel, and will be sufficient to retain liquid that is poured into the tall funnel 152 at a considerably faster flow rate than the short, squat, shallow funnel of Farris could receive without overflow.

Still other features of the tall funnel 152 will occur to those who are skilled in the art and are in a position to see and evaluate how the tall funnel 152 can best be used in ways that are better than is possible with the funnel of Farris.

Figure 3:
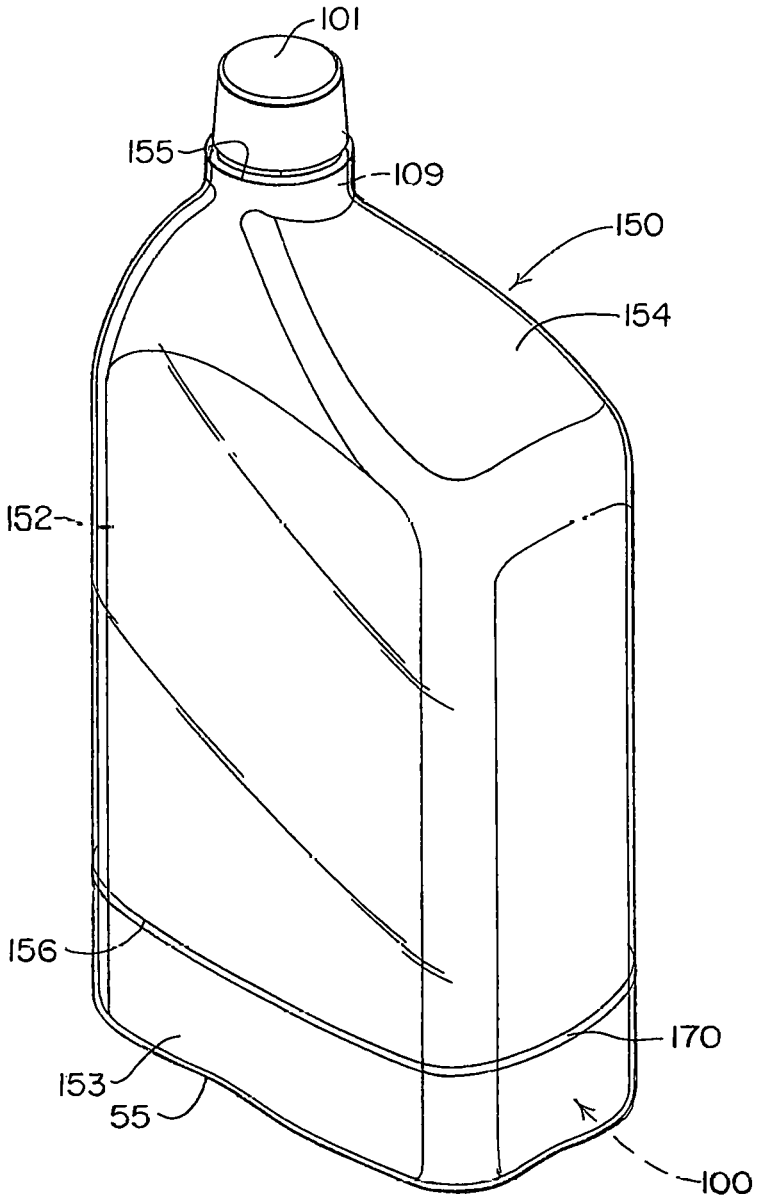

What is shown in FIG. 3 is an alternative embodiment that is a simplification of the embodiment shown in FIG. 2, in that no tear strip or rip cord (such as is indicated in FIG. 2 by the numeral 160) needs to be removed in order for the cap 101 to be grasped and twisted off of the container 100 to open the container 100.

What is particularly desirable about the embodiment shown in FIG. 3 is that, when an entire volume of engine oil is to be drained from, and replaced in, an engine (not shown), all that needs to be done to prepare to efficiently fill an oil-drained engine is to replace the engine's drain plug (not shown), and then to proceed with engine oil replenishment by removing only one of the funnels 152 from a first of a sequence of the containers 100, wherefores the one removed funnel 152 is positioned (as is needed to duct liquid into an inlet of the engine), so the capless containers 100 can each be emptied in sequence into the properly positioned funnel 152—while all of the other funnels 152 are simply left in place on their associated containers 100.

Figure 4:
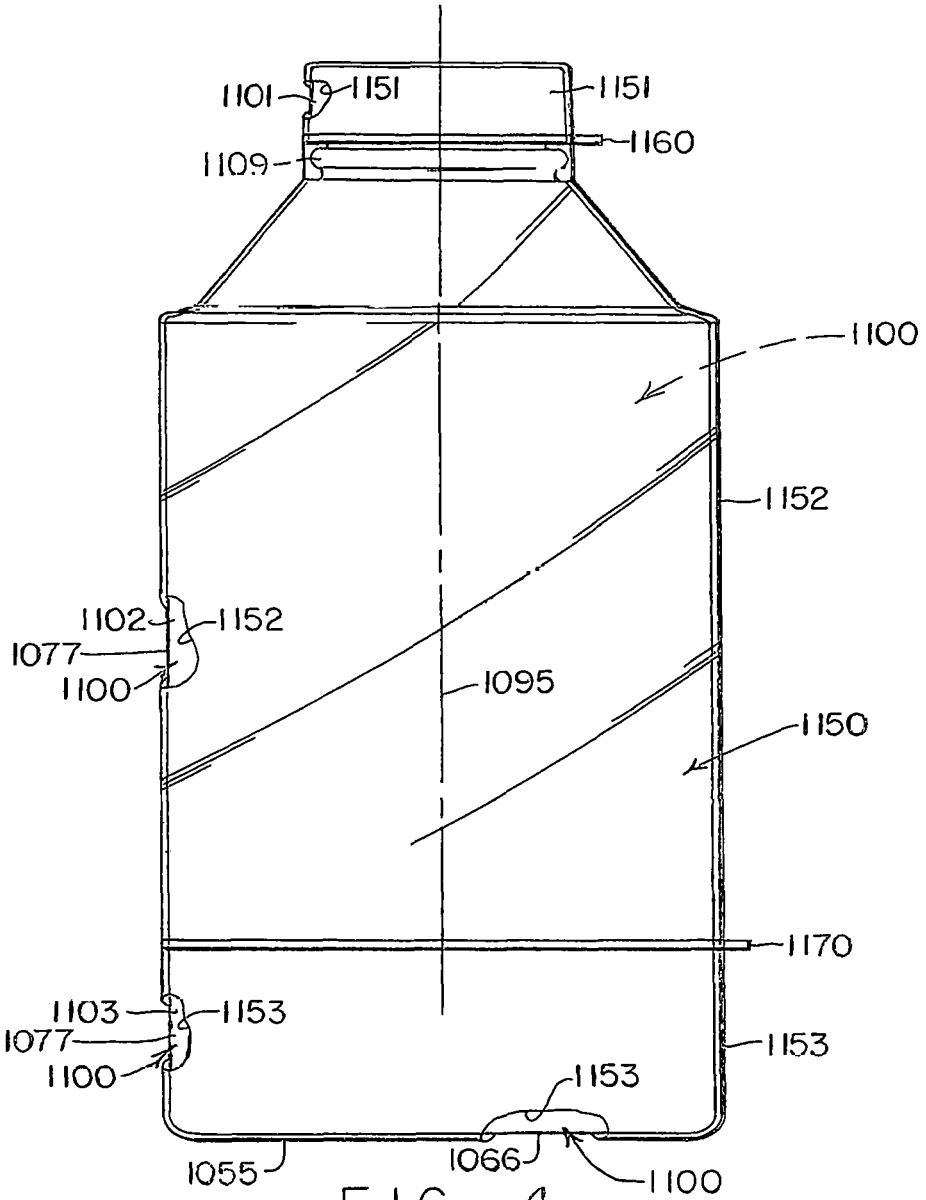
FIG. 4 is a side elevational view of a different form of upstanding container such as is in wide use to contain measured quantities of household or automotive liquids such as motor oil or window-washer fluid, or other liquids for cleaning, coating, lubricating and treating selected surfaces of various objects, with the view showing a protective cover formed by a relatively thin layer of transparent plastic material that closely overlies, wraps and grips the upstanding container to provide a protective cover that extends around the perimeter of the upstanding container (but may not reach farther radially inwardly than is designated by broken-line loops that are shown in FIG. 5 beneath a bottom wall and atop a cap of the container; and, FIG. 5 is a perspective view showing the upstanding container of FIG. 4, with the tear strips or rip cords being removed from other portions of the protective cover, with the cylindrical top portion of the protective cover removed and shown above the container so a conventional screw-on or a snap-on cap of the container can be viewed, and with a bottom portion of the protective cover removed and shown beneath the upstanding container, whereby the inverted funnel shape of the central portion of the protective cover can be seen where it is still in place on a central portion of the container.
Figure 5:
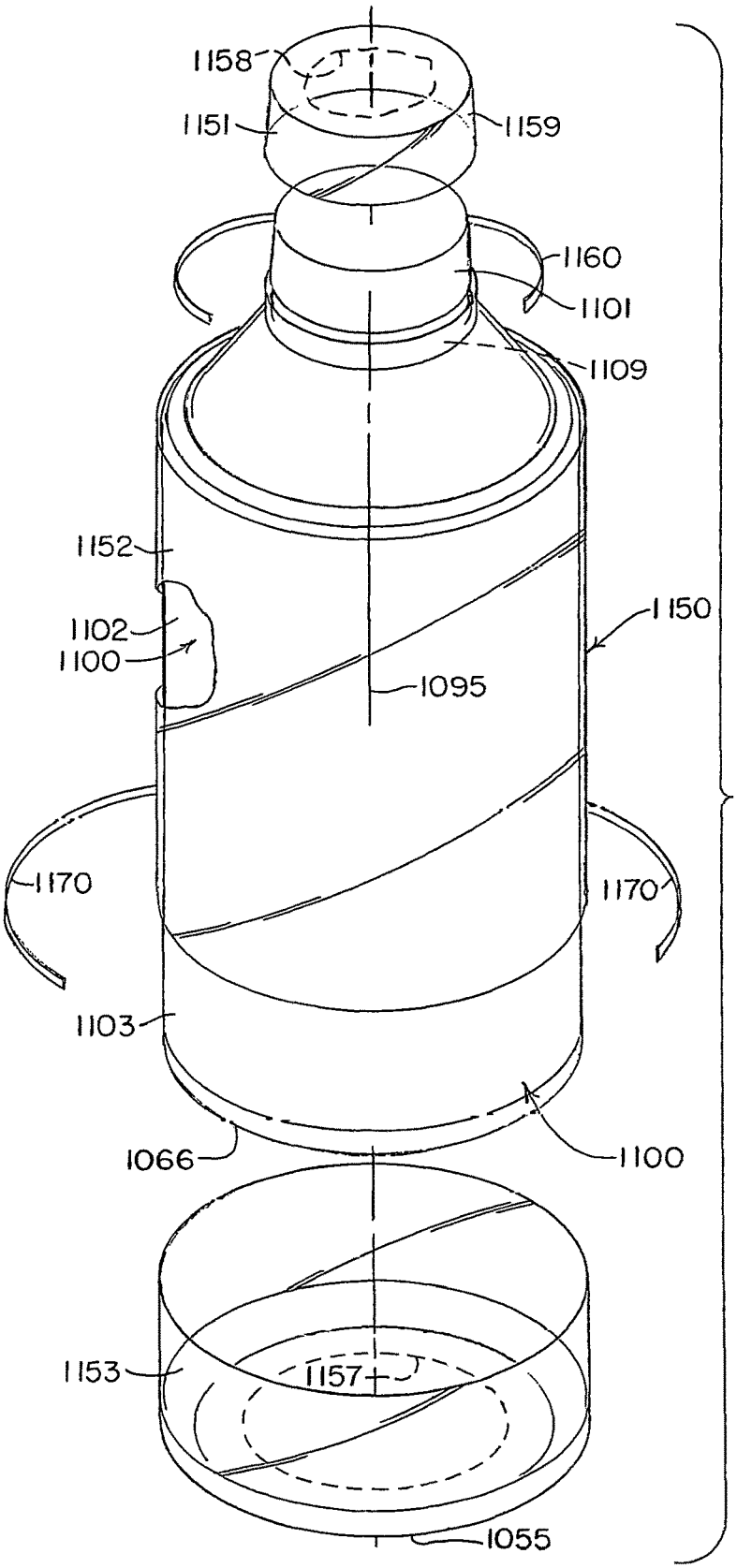

Turning now to FIGS. 4 and 5, a differently configured container 1100 is shown that has a protective cover 1150 that preferably closely hugs the differently configured container 1100. The container 1100 can be manufactured in a variety of sizes having a variety of capacities for containing a variety of quantities of many of the same liquids or fluids that are contained by the containers 100 shown in FIGS. 1 and 2.

Rather than to repeat some of the explanations presented above regarding features of the container 1100 that "correspond" to features of the container 100, most of the reference numerals that are used in FIGS. 4 and 5 have a magnitude greater by a factor of one-thousand to the reference numerals that are appear in FIGS. 1 to 3. What this means is that, for example, just as the protective cover 150 shown in FIGS. 1 and 2 has a central portion 152, the protective cover 1150 shown in FIGS. 4 and 5 also has a central portion that is designated by the reference numeral 1152. And, just as the center portion 152 is occasionally referred to as the "tall funnel 152," so too, is the central portion 1152 occasionally referred to as a "tall funnel 1152").

Referring now to FIGS. 4 and 5, the upstanding container 1100 may be formed from plastic material or from other materials including metal and coated paper products. However, the protective cover 1150 is preferably formed from a thin layer or film of see-through plastic material that is sufficiently transparent as to not shroud, cloud or to render unreadable such information as may be printed directly onto the exterior of the container 1100 by use of an adhesively attached printed label (not shown).

Many features of the container 1100 shown in FIGS. 4 and 5, and of the protective cover 1150 are symmetrical about an imaginary upstanding central axis 1095 shown in FIGS. 4 and 5. Even the neck 1109 of the container 1100 concentrically encircles the axis 1095.

In FIG. 4, an upper portion 1151, a central portion 1152, and a lower portion 1153 of the protective cover 1150 are broken away to permit the numerals 1101, 1102, 1103 to designate an upper part 1101, a central part 1102 and a lower part 1103, respectively, of the upstanding container 1100. FIG. 5 also has a broken away portion that permits a small region of the container 1100 to be seen.

In FIGS. 4 and 5, the protective cover 1150 is provided with an upper tear strip, rip cord or the like, indicated by the numeral 1160. Likewise, the protective cover 1150 is also provided with a lower tear strip, rip cord or the like, indicated by the numeral 1170. Each of the tear strips or rip cords 1160, 1170 can be pulled independently of the other, to selectively disconnect the cover portions 1151, 1152, 1153 from each other.

As is shown in FIG. 5, pulling, removing or otherwise releasing the upper tear strip 1160 will separate the upper portion 1151 of the protective cover 1150 from the central portion 1152 of the protective cover 1150. Likewise, pulling, removing or otherwise releasing the lower tear strip 1170 will separate the central portion of the protective cover 1150 from the lower portion 1153 of the protective cover 1150.

As is best shown in FIG. 5, the upper part of the container 1100 constitutes a removable cap (designated by the numeral 1101) that is preferably of the common snap-on/snap-off or screw-on/screw-off type such as is commonly found on cans of power steering fluid and fuel treatment fluids, and the like.

It will be understood, however, that the type of cap 1101 that may be provided on the upstanding container 1100 is of little concern to the present invention, except that whatever type of cap 1101 is chosen for selectively opening and closing an upwardly-facing opening (not shown) of the container 1100 is preferably of a type having an exterior surface that can be gripped by the upper portion 1151 of the protective cover 1150 that surrounds the cap 1101—to assist in holding the cap 1101 on the container 1100 in a closed position.

What is significant about the protective cover 1150 is that its central portion 1152 can be slided off the exterior wall of the container 1100 once the tear strips or rip cords 1160 and 1170 (or the like) are pulled, removed or otherwise released so that the top portion 1151 and the bottom portion 1153 of the protective cover 1150 no longer are connected to, and no longer function to retain the relatively tall, funnel-shaped, central portion 1152 of the protective cover 1150 on the central portion 1102 of the container 1000.

Just as is the situation with the container 100 and the protective cover 150 shown in FIGS. 1 and 2, the "how" and "why" (that explain the exactly how and exactly why the central portion 1152 of the protective cover 1150 preferably serves to snugly protectively cover the central portion 1102 of the container 1100 until the upper portion 1151 and the lower portion 1153 of the are detached from the central portion 1152 of the protective cover 1150) can be dealt with in many different ways. The possibilities discussed previously in conjunction with the central portion 152 of the cover 150 being removable from the container portion 102 are also applicable to explain how the tall central portion 1152 of the cover 1150 is removable from the container portion 1102.

In FIG. 2, broken lines 157 and 158 indicate possible locations where bottom portions and top portions of the protective cover 150 can terminate if the bottom and top portions of the protective cover 150 are not to extend completely across the bottom and top portions, respectively, of the container 150 (i.e., are not to fully underlie the bottom wall 66 of the container 150, and are not to completely overlie the top wall of the cap 101 of the container 150).

Similarly, in FIG. 5, broken lines 1157 and 1158 indicate possible locations where bottom portions and top portions of the protective cover 1150 can terminate if the bottom and top portions of the protective cover 1150 are not to extend completely across the bottom and top portions, respectively, of the container 1150 are not to fully underlie the bottom wall 1066 of the container 1150 and are not to fully overlie the top wall of the cap 1101 of the container 1150.

Although the invention has been described in its preferred form with a certain degree of particularity, it is understood that the present disclosure of the preferred form has been made only by way of example, and that numerous changes in the details of construction and the combination and arrangement of parts and the manner of operation may be resorted to without departing from the spirit and scope of the invention. It is intended to protect whatever features of patentable novelty that exist in the invention disclosed herein.

What is claimed is:

1. A protective cover configured to closely continuously overlie an exterior surface of an upstanding container having an internal chamber capable of retaining a quantity of liquid, wherein:

the protective cover comprises a plurality of separately removable cover portions that are integrally formed, but are able to be disconnected from each other to enable separation from the exterior surface of the upstanding container;

each of the cover portions perimetrically wraps a corresponding different portion of the exterior surface of the upstanding container;

prior to disconnection from each other, the plurality of cover portions cooperate to surround at least some of top and bottom parts of the exterior surface of the upstanding container to hold the protective cover in place on the exterior surface of the upstanding container;

one cover portion of the plurality of separately removable cover portions is configured to closely wrap a majority of the height of the exterior surface area of an upstanding sidewall of the container including a neck part of the container; and the one cover portion is configured so that, when inverted after being removed from the exterior surface of the upstanding container, it forms a relatively tall funnel.

2. The protective cover of claim 1 wherein the cover portion is configured so that, when inverted after being removed from the exterior surface of the upstanding container, it forms a relatively tall funnel capable of containing more than half of the liquid that can be contained in the internal chamber of the container.

3. The protective cover of claim 1 wherein, when the plurality of removable cover portions are perimetrically wrapping the exterior surface of the container, adjacent regions of different ones of the removable cover portions are connected by a separately removable tear strip that disconnects the adjacent regions when the tear strip is removed from the exterior surface.

4. The protective cover of claim 1 wherein the plurality of separately removable cover portions include two substantially adjacent regions of a piece of thermoplastic material that each perimetrically wraps a different part of the exterior surface of the container, with the substantially adjacent regions being releasably connected along substantially adjacent edges of the substantially adjacent regions by a narrow tear-off strip of cover material.

5. The protective cover of claim 4 wherein the two substantially adjacent regions and the narrow connecting tear-off strip of cover material are integrally formed portions of the protective cover.

6. The protective cover of claim 1 wherein, prior to being removed from the container's exterior surface, one of the separately removable portions of the protective cover perimetrically closely wraps at least a part of a cap of the container, to thereby assist in holding the cap in place on a neck of the container.

7. The protective cover of claim 1 wherein, prior to being removed from the container's exterior surface, one of the separately removable portions of the protective cover extends closely across the bottom part of the container's exterior surface to assist in holding the protective cover in place on the exterior surface of the container.

8. The protective cover of claim 1 formed from thin, substantially transparent thermoplastic material that overlies and snugly wraps the exterior surface of the container, and permits information printed on the exterior surface of the container to be viewed legibly through the protective cover.

9. The protective cover of claim 1 wherein the protective cover is formed from a puncture-resistant plastic material that serves as a liquid barrier to retain liquid from the internal chamber of the container in the event that the container, itself should leak or be punctured.

10. The protective cover of claim 1 wherein the separately removable portions are cooperatively configured to closely overlie an upstanding sidewall of the container, a reduced diameter upstanding neck portion of the container, and a tapered top wall of the container that transitions from the upstanding sidewall to the reduced diameter neck portion of the container.

11. A substantially transparent protective cover formed from thermoplastic material and configured to closely continuously surround a majority of the height of an exterior sidewall surface of an upstanding container having an internal chamber capable of containing and retaining a quantity of liquid, wherein:

the protective cover comprises a plurality of protective cover portions configured to snugly overlie different perimetrically extending parts of the exterior sidewall surface of the container;

the plurality of protective cover portions are integrally formed, but are severable one from the other so as to be separately removable from the exterior sidewall surface of the container prior to disconnection from each other, the plurality of protective cover portions cooperate to surround at least some of top and bottom parts of the exterior sidewall surface of the upstanding container to hold the protective cover in place on the exterior sidewall surface of the upstanding container; and one cover portion of the plurality of protective cover portions is configured so that, when inverted after being removed from the exterior sidewall surface of the upstanding container, it forms a relatively tall funnel.

12. The protective cover of claim 11 wherein one cover portion of the plurality of protective cover portions is configured to closely wrap a majority of the height of the exterior sidewall surface of the container including an upstanding neck part of the container.

13. The protective cover of claim 12 wherein the one cover portion is configured to, when inverted after being removed from the exterior sidewall surface of the upstanding container, form the relatively tall funnel.

14. The protective cover of claim 13 wherein two of the plurality of cover portions have substantially adjacent regions that perimetrically wrap the exterior sidewall surface and are connected by a separately removable tear strip that disconnects the adjacent regions when the narrow connecting tear strip is removed from the exterior sidewall surface of the container.

15. The protective cover of claim 14 wherein the two substantially adjacent regions and the narrow connecting tear strip are integrally formed.

16. The protective cover of claim 15 wherein, prior to being removed from the container's exterior sidewall surface, one of the two separately removable cover portions perimetrically closely wraps at least a part of a cap of the container to assist in holding the cap in place on a neck of the container.

17. The protective cover of claim 15 wherein, prior to being removed from the container's exterior sidewall surface, one of the separately removable portions of the protective cover extends closely across a bottom part of the container's exterior surface to assist in holding the protective cover in place on the exterior sidewall surface of the container.

18. The protective cover of claim 15 formed from thin, substantially transparent thermoplastic material that overlies and snugly wraps the exterior sidewall surface of the container, and permits information printed on the exterior sidewall surface of the container to be viewed legibly through the protective cover.

19. The protective cover of claim 15 wherein the protective cover is formed from a puncture-resistant plastic material that serves as a liquid barrier to retain liquid from the container in the event that the container, itself should leak or be punctured.

20. The protective cover of claim 12 wherein the one protective cover portion is configured to closely overlie a) a majority of the upstanding sidewall of the container, b) a reduced diameter neck portion of the container, and c) a tapered top wall of the container that transitions from the upstanding sidewall to the reduced diameter upstanding neck part of the container.

* * * * *